US006988929B2

(12) United States Patent
Wong

(10) Patent No.: US 6,988,929 B2
(45) Date of Patent: Jan. 24, 2006

(54) SPEED WHEEL

(76) Inventor: Che Ming King Wong, Flat F, 5/F, Block 4, PH 1, Laguna Verde, Hunghom, Kowloon (HK)

( * ) Notice: Subject to any disclaimer, the term of this patent is extended or adjusted under 35 U.S.C. 154(b) by 21 days.

(21) Appl. No.: 10/754,666

(22) Filed: Jan. 12, 2004

(65) Prior Publication Data

US 2005/0153627 A1 Jul. 14, 2005

(51) Int. Cl.
*A63H 29/02* (2006.01)
*A63H 29/22* (2006.01)

(52) U.S. Cl. ..... 446/462; 446/465; 446/470

(58) Field of Classification Search ..... 446/431, 446/448, 457, 458, 462, 464, 465, 470
See application file for complete search history.

(56) References Cited

U.S. PATENT DOCUMENTS 2,144,461 A * 1/1939 Muller ..... 446/464
4,373,290 A * 2/1983 Goldfarb et al. ..... 446/202
4,443,967 A * 4/1984 Jones et al. ..... 446/462

FOREIGN PATENT DOCUMENTS

GB 2130902 A * 6/1984

* cited by examiner

*Primary Examiner*—Bena B. Miller
(74) *Attorney, Agent, or Firm*—Sughrue Mion, PLLC

(57) ABSTRACT

A miniature-sized toy vehicle that is set in motion with a push along straight-ahead path of movement and which rides on a wheel bearing in depending relation from the vehicle chassis, the revolving mode of which wheel bearing contributes to an optimum length of travel, and wherein the vehicle chassis has a straight movement about the wheel bearing and during its travel will not turn aside and keep a proper position for travel along straight-ahead path of movement, to further increase the length of travel of the toy vehicle.

5 Claims, 3 Drawing Sheets

SPEED WHEEL

INTRODUCTION

In practice, it has been observed that children lack the dexterity and coordination to start in motion a toy vehicle that is exactly in straight-ahead path of movement.

SUMMARY OF THE INVENTION

A miniature-sized toy vehicle that is set in motion with a push along straight-ahead path of movement and which rides on a wheel bearing in depending relation from the vehicle chassis, the revolving mode of which wheel bearing contributes to an optimum length of travel, and wherein the vehicle chassis has a straight movement about the wheel bearing and during its travel will not turn aside and keep a proper position for travel along straight-ahead path of movement, to further increase the length of travel of the toy vehicle.

BRIEF DESCRIPTION OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
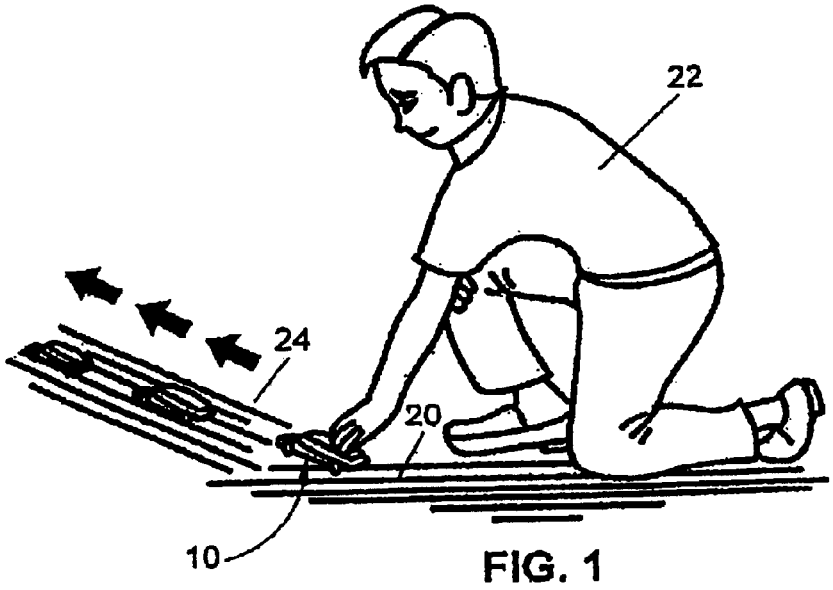
FIG. 1 is a perspective view illustrating a typical use of the within inventive miniature-sized toy vehicle.
Figure 2:
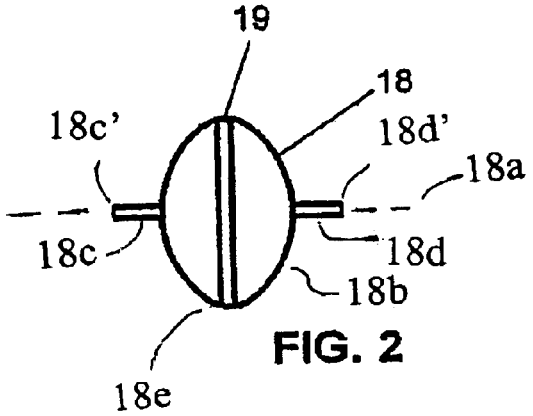
FIG. 2 is a front view of Speed Wheel.
Figure 3:
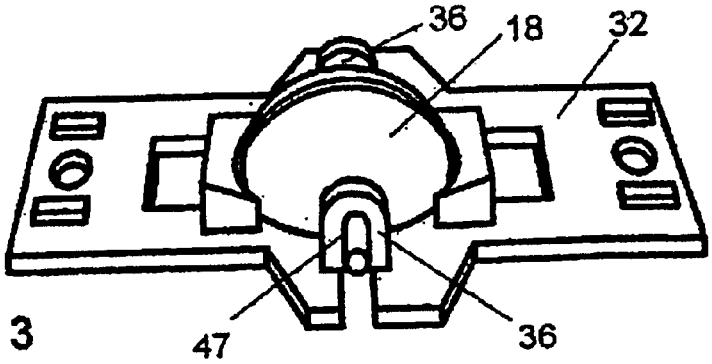
FIG. 3 is side view of vehicle chassis with Speed Wheel bearing.
Figure 4:
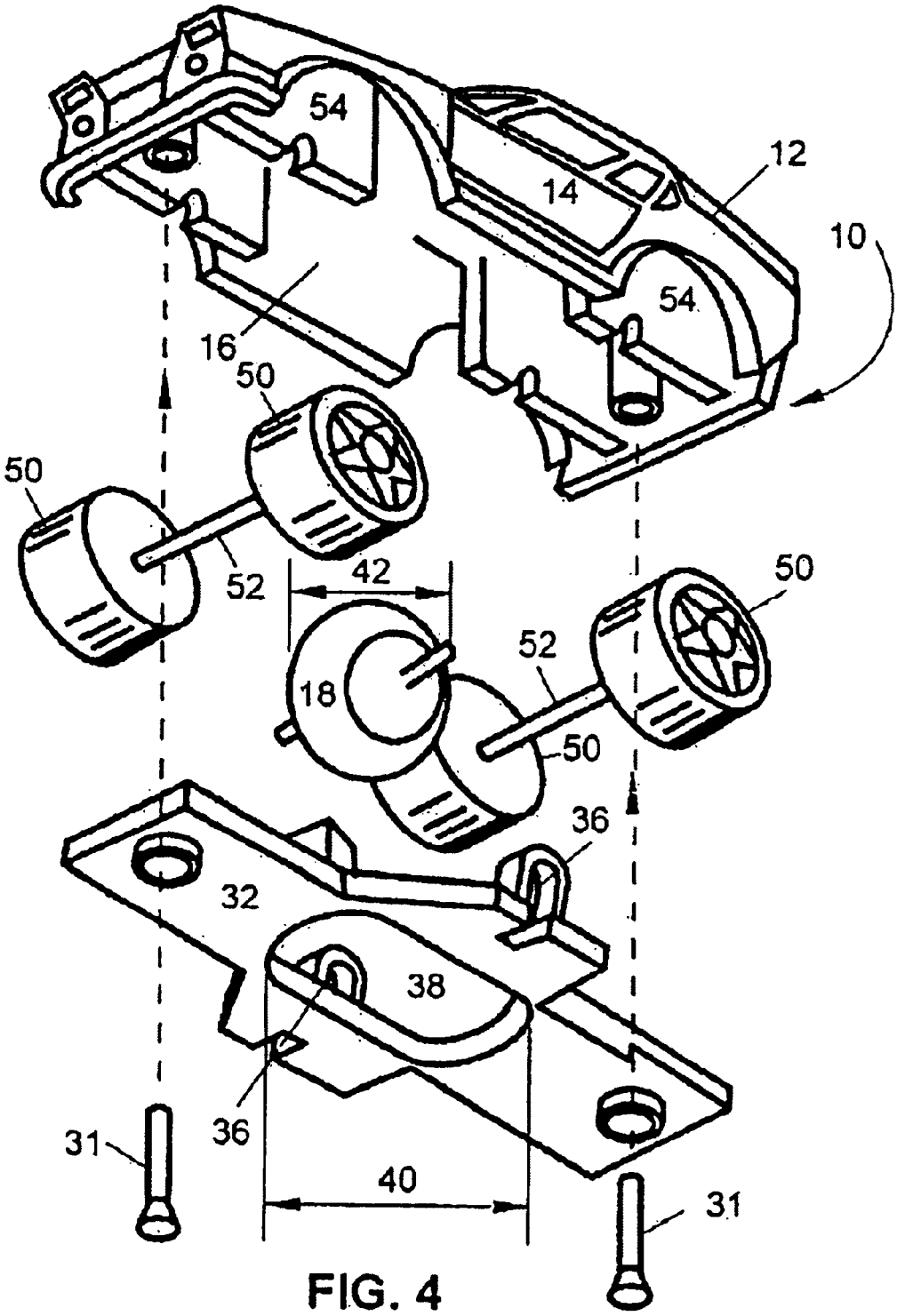
FIG. 4 is an exploded perspective of the toy vehicle.
Figure 5:
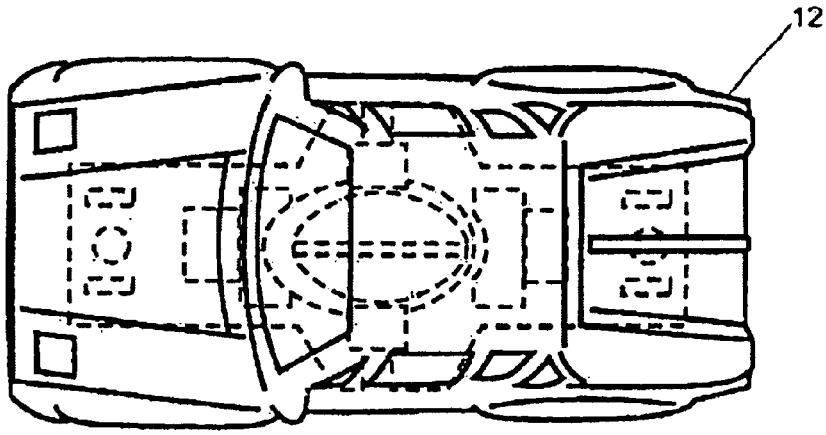
FIG. 5 is a plan view thereof.
Figure 6:
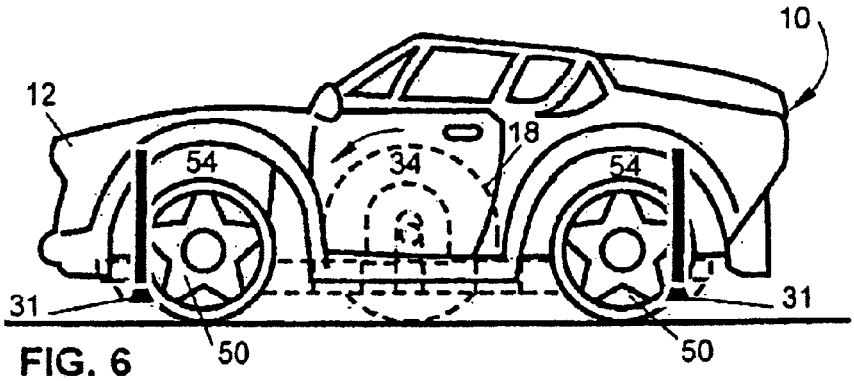
FIG. 6 is a sectional view, as taken along line 4—4 of FIG. 3.
Figure 7:
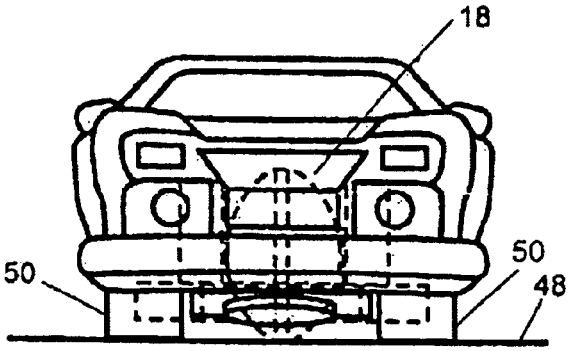
FIG. 7 is a front view of the within inventive toy vehicle.

Shown is the drawings in a preferred width 17.4 mm, length of 35.6 mm, and height of 13.2 mm, is a miniature-size toy vehicle, generally designated 10, having a body 12 consisting of a wall 14 whose exterior surface simulates the appearance of a full-sized vehicle and an internal surface which bounds a compartment 16 for the positioning of a Speed Wheel bearing 18 which has a width of 0.8 mm flat surface on the wheel edge 19, 9.4 mm in diameter, 6 mm in thickness and two axles with 1 mm in diameter. The structure is compatible with an operating mode of urging the toy vehicle 10, in response to a manual push or thrust 20 of a user 22, in a steady straight-ahead path of movement 24 and not going circular movement, the length of which, if of a maximum extent, contributes to the play value of the toy vehicle 10. As illustrated in FIG. 2, the compartment 16 is provided with a plurality of corners, at least one of wheels 50 being mounted adjacent each corner of the body. The speed wheel 18 has an axis of rotation 18*a* and comprises a body mass 18*b* formed centrally on the axis of rotation 18*a* and has opposed axial bearing portions 18*c*, 18*d* disposed on the axis of rotation. Each bearing portion 18*c*, 18*d* extends from the body mass 18*b* to a distal end 18*c*', 18*d*'. As is illustrated in FIGS. 2 and 3, the body mass 18*b* is formed with a circular cross section at a central portion 18*e* along the axis of rotation 18*a* and tapers from the central portion 18*e* to each of the axial bearing portions 18*c*, 18*d* towards a respective distal end 18*c*', 18*d*'. The speed wheel 18 is formed with the circumferential wheel edge 19 at the central portion 18*e*.

Appropriately attached, as by screws 31 or the like, as a closure for the Speed Wheel positioning compartment 16 is an aptly referred-to Roller Wheel bearing means in the specific form of a plate 32 which contributes to the low-friction revolving 34 of the Speed Wheel 18 and, which plate 32 to this end has a pair of knobs 36 which has a gap 4 mm in length that support a Speed Wheel 18 within the oval opening 38 of a selected size 40 which is slightly oversized with respect to the size 42 of Speed Wheel 18 allows Speed Wheel 18 moving up and down and so that reduces friction with the plate 32 and provides higher speed in revolving 34 of Speed Wheel 18.

The body 12 is held in a horizontal position relative to the riding surface 48 by four simulated vehicle wheels 50 at opposite ends of axles 52 appropriately attached to internal walls 54 depending from the body 12, but otherwise the wheels 50 are not functional in contributing to the length of travel of toy vehicle 10. What is functional to the length of travel of the toy vehicle 10 is the Speed Wheel 18 in a revolving mode 34 in contact, as at 47, with the knobs 36 integral to the plate 32.

While the toy vehicle herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A miniature-sized toy vehicle configured for manual push in motion along a straight-ahead path of movement and having a hollow body defining a compartment and a plurality of corners, and a plurality of wheels, at least one of said wheels being mounted adjacent each corner of said body, comprising:

a speed wheel having an axis of rotation, said speed wheel comprising a body mass formed centrally on said axis of rotation and opposed axial bearing portions disposed on said axis of rotation, each of said bearing portions extending from said body mass to a distal end, said body mass being formed with a circular cross section at a central portion along said axis of rotation and tapering from said central portion to each of said axial bearing portions towards a respective distal end, and formed with a circumferential wheel edge at said central portion; and a speed wheel mounting plate having a centrally located speed wheel bearing-mounting opening, an oval wall bounding said opening, and a pair of support knobs formed integrally with said plate, each having an internally arched configuration that defines curved bearing surface and each extending inwardly into said compartment;

wherein, each of said axial bearing portions are revolvably supported in a respective curved surface of said support knobs and said speed wheel bearing is disposed in said speed wheel mounting opening of said mounting plate so as to contact a riding surface for said toy vehicle.

2. The miniature-sized toy vehicle as recited in claim 1, wherein said speed wheel is oval shaped and said body mass is equally distributed on opposite sides of said central portion.

3. The miniature-sized toy vehicle as recited in claim 1, wherein said speed wheel is sized to provide a depending surface thereof projected through said speed wheel mounting opening and into contact with a riding surface and effective to hold said display four wheels in slight clearance positions with only nominal contact with said riding surface.

4. The miniature-sized toy vehicle as recited in claim 1, further comprising means attaching said speed wheel mounting plate with said speed wheel supported in said speed wheel mounting opening thereof to said body so that said vehicle has a straight-ahead movement relative to said supported speed wheel, whereby in response to a manual push said toy vehicle is transported on said revolving speed wheel in a straight-ahead path of movement to contribute to a length of travel of said toy vehicle along said path of movement.

5. The miniature-sized toy vehicle as recited in claim 1, wherein said mounting plate is configured to close said compartment.

* * * * *